US006231361B1

(12) United States Patent
Ko et al.

(10) Patent No.: US 6,231,361 B1
(45) Date of Patent: May 15, 2001

(54) SHIELDED MALE ELECTRICAL CONNECTOR

(76) Inventors: Ming-Shien Ko, No. 14-5, Ta Chih Rd., ChangHua City, ChangHua Hsien (TW); Ping-Kun Hsueh, 840 Glenwick Ave., Walnut, CA (US) 91789

( * ) Notice: Subject to any disclaimer, the term of this patent is extended or adjusted under 35 U.S.C. 154(b) by 0 days.

(21) Appl. No.: 09/541,705

(22) Filed: Apr. 3, 2000

(30) Foreign Application Priority Data

Dec. 21, 1999 (TW) ..... 88221787

(51) Int. Cl.[7] ..... H01R 29/00
(52) U.S. Cl. ..... 439/172; 439/141; 439/171
(58) Field of Search ..... 439/578, 171, 439/172, 103, 131, 141, 310

(56) References Cited

U.S. PATENT DOCUMENTS 3,025,486 * 3/1962 Falconer ..... 439/103
3,478,296 * 11/1969 Schmitt ..... 439/141 X
4,042,291 * 8/1977 Moriyama ..... 439/310 X

* cited by examiner

*Primary Examiner*—Brian Sircus
*Assistant Examiner*—Son V. Nguyen
(74) *Attorney, Agent, or Firm*—Dougherty & Troxell

(57) ABSTRACT

An improved connector for coupling with a signal connector for signal transmission has a movable shield sleeve to cover the naked lead of the power signal line for preventing the connector from short circuit or causing harmful incidents to people. It also provides a stronger connection and enhances safety.

3 Claims, 4 Drawing Sheets

SHIELDED MALE ELECTRICAL CONNECTOR

FIELD OF THE INVENTION

This invention relates to an improved connector electrical devices which transmit power driven signals, one that has a shield structure to prevent metallic leads from outside exposure and enhances connection strength.

BACKGROUND OF THE INVENTION

Conventional electrical devices usually have a connector for transmitting power driven signal with an external signal line. The connector usually includes a male and a female connector to make connection simple. FIG. 1 illustrates a typical conventional connector now being widely used. It has a conductive male connector 1 and a female connector 2. The female connector 2 includes a fastener 22 which has a bore 21 formed therein. Inside the bore 21, there is a metallic barrel fastener 23 which connects to a conductive wire 24. The male connector 1 may be plugged into the bore 21 to connect with the barrel fastener 23 for transmitting a signal through the wire 24.

The conductive male connector 1 is naked and exposed to ambient environment. It is prone to produce short circuit when not being properly used. It may also be disconnected easily from the female connector 2 and may result in harmful accident to children when not being properly guarded.

With increasing number of electric devices and gadgets targeting children market nowadays, it becomes a pressing need to design a safer connector to lower the potential risk to users, particularly to children.

SUMMARY OF THE INVENTION

It is an object of this invention to provide an improved connector for power signal transmission use in electrical devices and to offer a higher adaptability and safety level to meet stricter safety specifications and requirements of future products.

The connector according to this invention has a shield around a naked male connector for engaging with a female connector so that short circuit accidents may be greatly reduced.

In one aspect of this invention, the shield sleeve structure includes a latching means for anchoring on the male connector and for freeing the male connector to move and engage with the female connector when in use.

In another aspect of this invention the male connector has a groove formed in a side wall to hold a resilient member therein. The shield sleeve has a stub extending in the groove and is movable by the resilient member in the groove. Hence the naked male connector may be protected by the shield sleeve from outside exposure all the time.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
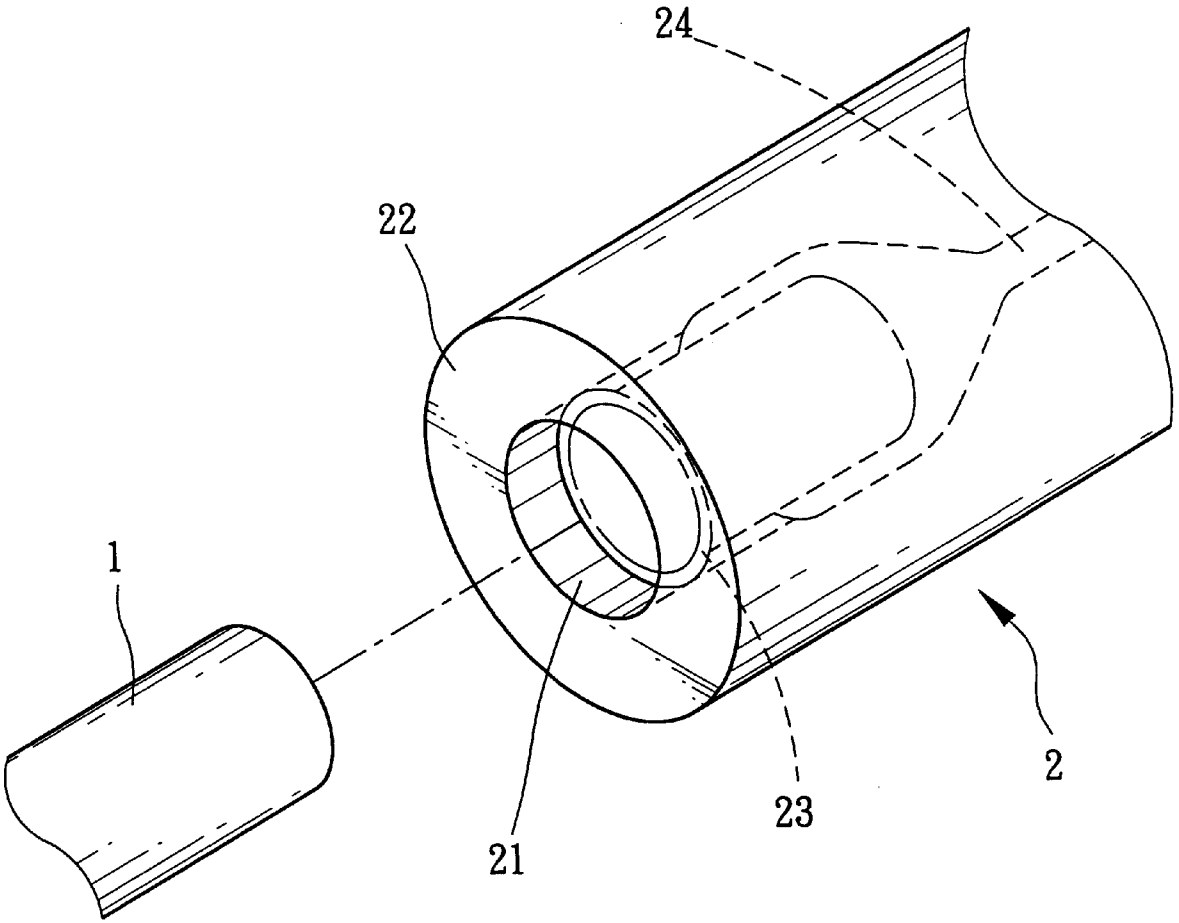
FIG. 1 (PRIOR ART)
FIG. 1 is a perspective view of a conventional connector.
Figure 2:
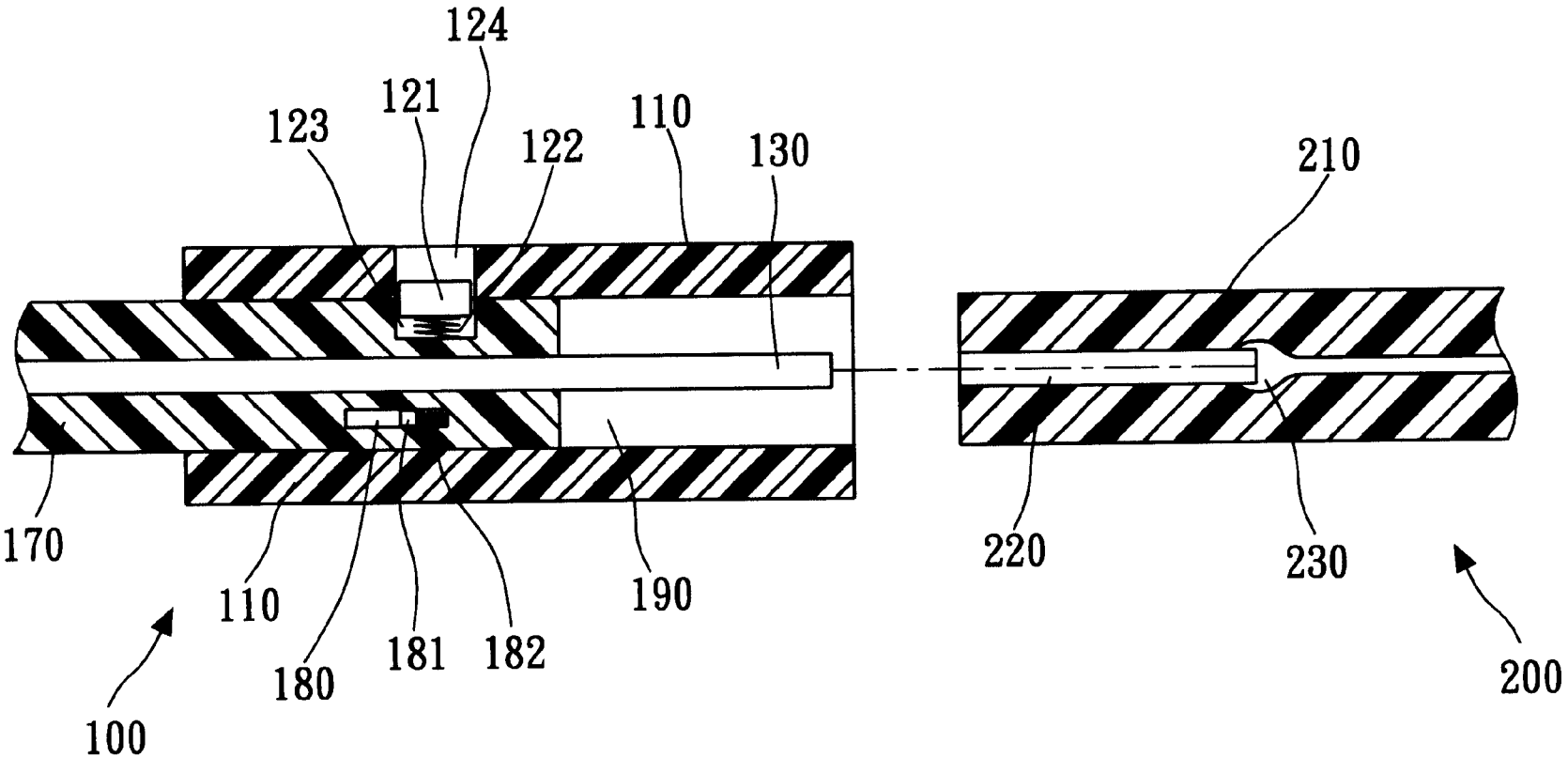
FIG. 2 is a sectional view of a first embodiment of this invention.
Figure 3:
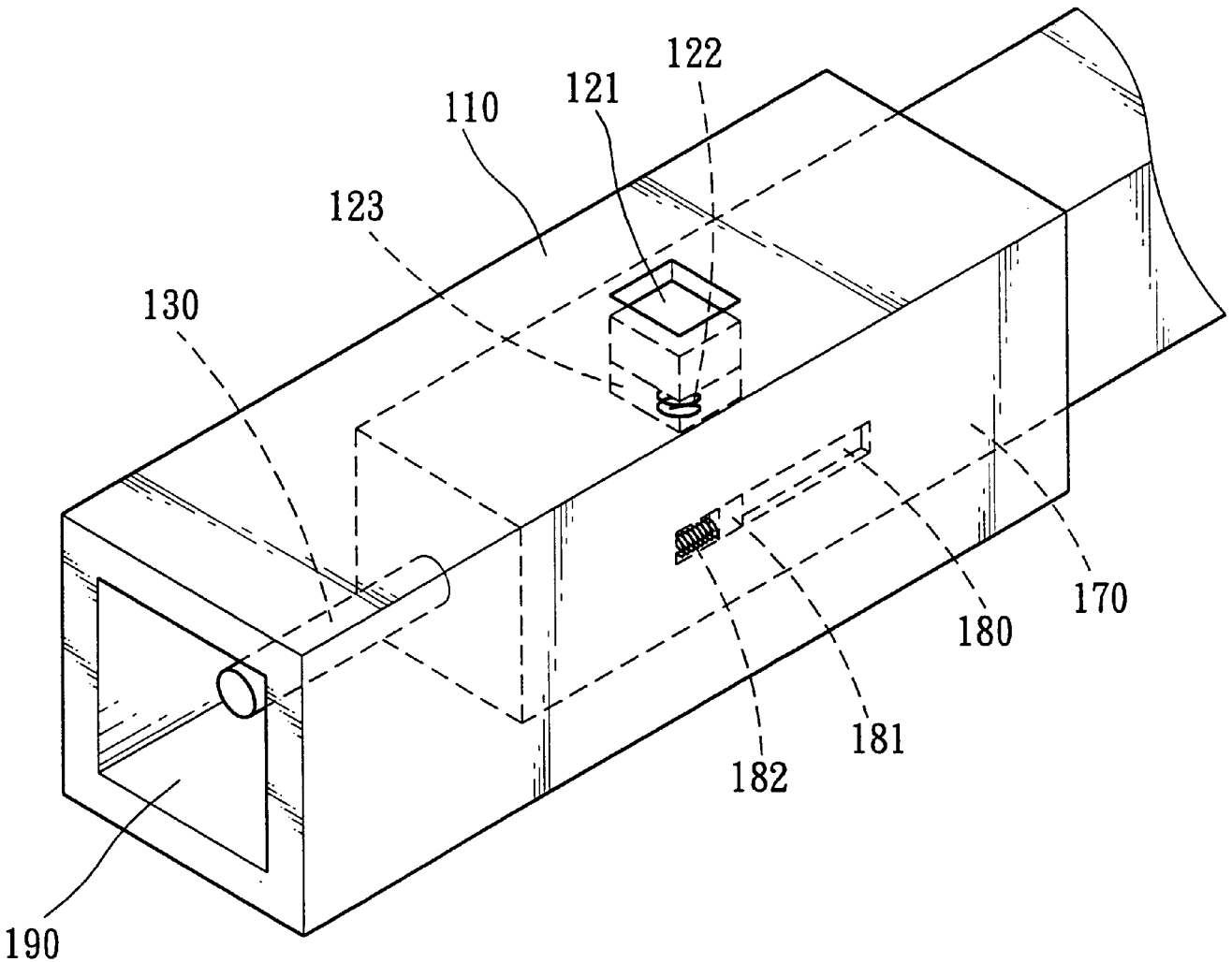
FIG. 3 is a perspective view of the first embodiment of this invention.

Referring to FIGS. 2 and 3, the connector 100 of this invention includes a connector head 170 which has a signal line embedded inside. The signal line lead 130 extends outside the connector head 170. Adjacent one end of the connector head 170, there is a first groove 123 in which a first resilient member 122 is held. Above the first resilient member 122, a button 121 is provided. The connector head 170 is housed in a shield sleeve 110 which has a second groove 124 mating against the first groove 123. When the button 121 is held in the first and second grooves 123 and 124 (as shown in FIG. 2), the lead 130 is completely held in a connection cavity 190 formed inside the shield sleeve 110 beyond one end of the connector head 170.

The signal connector 200 is generally constructed like a conventional female connector which includes a connector body 210 having a bore 220 formed inside connecting with a signal line 230. The connector body 210 is engageable with the connection cavity 190.

In use, when the lead 130 is inserted into the bore 220, the connector body 210 will be housed in the connection cavity 190 to form a tight and shielded connection guarded by the shield sleeve 110. It becomes a sturdy and highly safe connection. The button 121 will keep the shield sleeve 110 stationary against the connector head 170 when the connector body 210 engages or disengages with the connection cavity 190. Even when disengaged, the shield sleeve 110 completely covers the lead 130. Hence the risks and hazards of an exposed naked connector that happens in a conventional connector may be avoided. The connector head 170 may further have a third groove 180 formed in a side wall. The shield sleeve 110 has a stub 181 extending into the third groove 180. There is a second resilient member 182 held in the groove 180 with one end thereof pushing the stub 181. By means of such structure, the shield sleeve 110 will be pushed forward beyond the connector head 170 such that the connection cavity 190 covers the head 130 all the time to further improve the safety.

Figure 4:
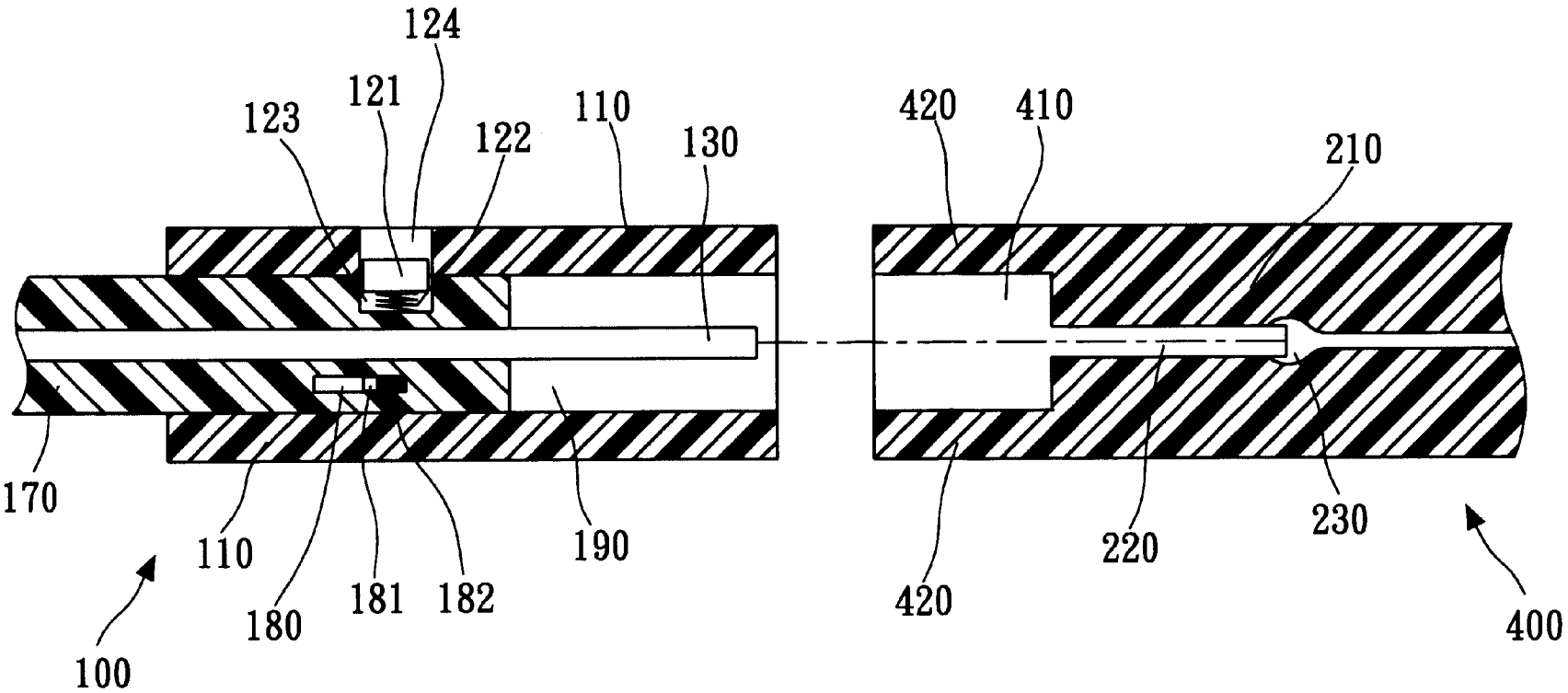
FIG. 4 is a sectional view of a second embodiment of this invention.

FIG. 4 shows a second embodiment of this invention. It has a connector 100 which is constructed like the one shown in FIG. 2. The signal connector 400 has a larger size than the connection cavity 190 and includes a guard rim 420 at one end which forms a cavity 410 inside large enough to hold one end of the connector head 170. There is also a connector body 210, a bore 220 and signal line 230 as shown in FIG. 2.

When in use, pressing the button 121 downward into the first groove 123 enables the connector head 170 to be movable axially inside the shield sleeve 110 so that one end of the connector head 170 may be pushed and inserted into the cavity 410 for plugging the head 130 into the bore 220.

When disconnected, the second resilient member 182 pushes the shield sleeve 110 so that the connector head 170 is pulled back from the cavity 410 to have the button 121 engaged with the second groove 124 again. The head 130 will then be covered by the shield sleeve 110 to avoid incident.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A shielded connector comprising:

a) a connector head having an end, a signal line inside the connector head having a lead extending outwardly from the end of the connector head, the connector head having a first groove;

b) a button located in the first groove;

c) a first resilient member acting on the button such that at least a portion of the button extends outwardly of the connector head;

d) a hollow shield sleeve having a second groove aligned with the first groove and engaged by the button to attach the shield sleeve to the connector head, the shield sleeve having a portion extending beyond the end of the connector head such that the lead is located completely within the shield sleeve;

e) an elongated third groove in the connector head;

f) a stub extending from the shield sleeve and engaging the elongated third groove; and, g) a second resilient member acting on the stub.

2. The shielded connector of claim 1 wherein the portion of the hollow shield sleeve extending beyond the end of the connector head is configured to receive a female connector therein such that the lead engages the female connector.

3. The shielded connector of claim 1 wherein the button has a cubical configuration.

* * * * *